US011391144B2

(12) United States Patent
Samuel

(10) Patent No.: US 11,391,144 B2
(45) Date of Patent: Jul. 19, 2022

(54) AUTONOMOUS WELLBORE DRILLING WITH SATISFICING DRILLING PARAMETERS

(71) Applicant: Landmark Graphics Corporation, Houston, TX (US)

(72) Inventor: Robello Samuel, Cypress, TX (US)

(73) Assignee: Landmark Graphics Corporation, Houston, TX (US)

( * ) Notice: Subject to any disclaimer, the term of this patent is extended or adjusted under 35 U.S.C. 154(b) by 113 days.

(21) Appl. No.: 16/913,340

(22) Filed: Jun. 26, 2020

(65) Prior Publication Data

US 2021/0404316 A1 Dec. 30, 2021

(51) Int. Cl.

| | |
|---|---|
| ***E21B 44/00*** | (2006.01) |
| ***E21B 44/02*** | (2006.01) |
| ***E21B 45/00*** | (2006.01) |
| ***E21B 47/12*** | (2012.01) |

(52) U.S. Cl.

CPC ..... *E21B 44/00* (2013.01); *E21B 44/02* (2013.01); *E21B 45/00* (2013.01); *E21B 47/12* (2013.01)

(58) Field of Classification Search

CPC ..... E21B 44/00; E21B 2200/22

See application file for complete search history.

(56) References Cited

U.S. PATENT DOCUMENTS

| | | | | |
|---|---|---|---|---|
| 6,026,912 | A | 2/2000 | King et al. | |
| 7,142,986 | B2 | 11/2006 | Moran | |
| 9,202,169 | B2 | 12/2015 | Al-Yami et al. | |
| 9,645,575 | B2 * | 5/2017 | Watson | G06N 7/005 |
| 2002/0120401 | A1 | 8/2002 | Macdonald et al. | |
| 2004/0256152 | A1 | 12/2004 | Dashevskiy et al. | |
| 2015/0218914 | A1 | 8/2015 | Marx et al. | |
| 2015/0294258 | A1 * | 10/2015 | Hildebrand | E21B 7/04 705/7.15 |
| 2017/0024452 | A1 * | 1/2017 | Budalakoti | G06F 16/24556 |
| 2018/0119535 | A1 | 5/2018 | Shen et al. | |
| 2019/0277130 | A1 | 9/2019 | Zarate Losoya et al. | |
| 2020/0183042 | A1 | 6/2020 | Amidi et al. | |
| 2021/0025269 | A1 * | 1/2021 | Zaripov | E21B 7/04 |

FOREIGN PATENT DOCUMENTS

| | | |
|---|---|---|
| EP | 1608843 | 12/2005 |
| GB | 2448622 | 10/2008 |
| WO | 2016209230 | 12/2016 |
| WO | 2019118055 | 6/2019 |
| WO | 2019147297 | 8/2019 |

OTHER PUBLICATIONS

GB Application No. GB2107054.5 , "Combined Search and Examination Report", dated Jan. 7, 2022, 10 pages.

PCT Application No. PCT/US2020/039847 , International Search Report and Written Opinion, dated Mar. 9, 2021, 11 pages.

* cited by examiner

*Primary Examiner* — Tara Schimpf

(74) *Attorney, Agent, or Firm* — Kilpatrick Townsend & Stockton LLP

(57) ABSTRACT

A system is described for controlling wellbore drilling operations autonomously using satisficing parameters. The system can determine a wellbore-drilling envelope defining a zone for satisficed values of drilling parameters for a drilling operation. The system can receive real-time data for the drilling parameters and can compare the real-time data to the wellbore-drilling envelope. The system can output a command for automatically controlling the drilling operation in response to comparing the real-time data to the wellbore-drilling envelope.

20 Claims, 6 Drawing Sheets

AUTONOMOUS WELLBORE DRILLING WITH SATISFICING DRILLING PARAMETERS

TECHNICAL FIELD

The present disclosure relates generally to wellbore drilling and, more particularly (although not necessarily exclusively), to autonomous drilling operations for wellbores.

BACKGROUND

A hydrocarbon well can include a wellbore drilled through a subterranean formation. A drilling operation to form the wellbore can involve various drilling parameters, such as weight on bit, revolutions per minute, rate of penetration, etc. Using the various drilling parameters, drilling equipment can be controlled to penetrate the subterranean formation and access a reservoir. The reservoir can include hydrocarbon fluid that can be extracted subsequent to the wellbore being drilled and completed.

During the drilling operation, the drilling parameters may be controlled or managed to ensure that drilling objectives are achieved. For example, a computing device can be used to monitor the drilling operation and control parameters for the drilling operation. Although the drilling parameters may be optimized to achieve a particular drilling objective, optimizing drilling parameters may involve significant data processing time and resources and may not account for real time changes occurring with respect to the drilling operation.

DETAILED DESCRIPTION

Figure 1:
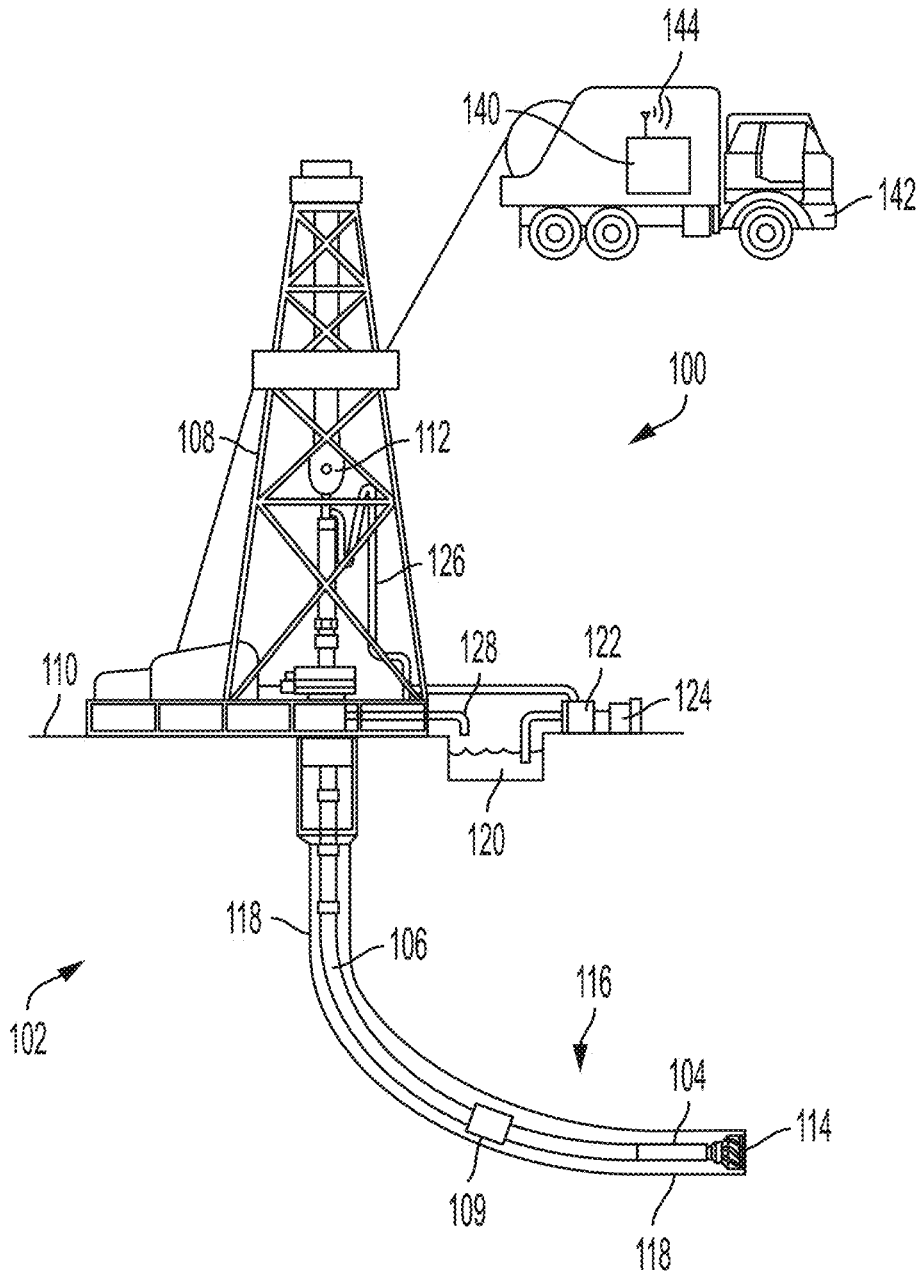
FIG. 1 is a cross-sectional view of a wellbore formed with drilling equipment using satisficing drilling parameters according to one example of the present disclosure.

Certain aspects and examples of the present disclosure relate to controlling a wellbore-drilling operation using drilling parameters having values in a wellbore-drilling envelope defining a satisficing zone for the drilling parameters. A wellbore-drilling envelope can define the satisficing zone as being values for parameters within constraints and the values of the parameters within the satisficing zone can be used to control a drilling operation to achieve a drilling objective satisfactorily. The satisficing zone can include optosatisficed parameters, which can be a subset of values for drilling parameters that are optimal for achieving the drilling objective. The wellbore-drilling envelope can be determined based on factors such as the drilling objective, information about the equipment being used to drill the wellbore, and real-time data being measured about the drilling operation being performed. Determining optimal values for parameters to use for the drilling operation may involve time-intensive analysis and data processing. By determining a satisficing zone, values that result in satisfactorily achieving a drilling objective can be determined faster and with less processing speed and power as compared to determining the optimal values. Whether the values are also optimal or not, the drilling objective can still be satisfactorily achieved. Calculating satisficing values of drilling parameters can be carried out quickly, which can enable the wellbore-drilling operation to rapidly adapt to changing conditions downhole.

Examples of drilling parameters can include weight on bit (WOB), rate of penetration (ROP), revolutions per minute (i.e., drill speed), torsional instability, lateral instability, hole cleaning, mechanical-specific energy, hydro-mechanical-specific energy, motor-stall weight, and motor-stall speed. Torsional instability can be a measure of self-excited vibration of a drill bit, which can cause large fluctuations in drill speed, can increase wear on the bit, and may cause drill-string failures such as stick-slip and vibration. Lateral instability can be a measure of how likely the wellbore is to buckle under a pressure value in the subterranean formation. Hole cleaning can be an ability of a drilling fluid to suspend and transport drilled cuttings, or other material, out of the wellbore. Mechanical-specific energy can be a measure of energy to remove a unit volume of rock. Hydro-mechanical-specific energy can be a measure of energy required for hydraulic fluid to remove a unit volume of rock. Motor-stall weight can be an amount of weight that causes a drill motor to stall. Motor-stall speed can be the speed, or revolutions per minute, of the drill motor that causes the drill motor to stall.

A wellbore system with high aspect ratio, in which the length of a wellbore is much larger than the diameter of the wellbore, can be highly stochastic. Calculating the optimized values for the parameters can take more time than is available during the wellbore-drilling operation, for example in the situation in which the operation uses real-time data sensing of wellbore information and uses automatically controlled drilling equipment. But, satisficing values of drilling parameters can be used to control the wellbore-drilling operation and achieve the drilling objectives timely, while also accounting for real-time data.

In drilling operations, parameters may be adjusted periodically in the drilling system, such as in discrete intervals, in response to changing conditions in the wellbore or the subterranean formation. A wellbore-drilling envelope defining a satisficing zone can be determined for each interval and values of parameters within the envelope can be used to control drilling equipment to achieve the drilling objective until the next interval. The system can estimate drilling or operational efficiency with newly calculated drilling parameters in a new discrete interval based on previous discrete interval drilling parameters and drilling results. The system can achieve better forward prediction of operational efficiency by extracting patterns from previously calculated drilling parameters, previously estimated drilling efficiency, and drilling results from previous discrete intervals.

Determining satisficing values of drilling parameters can involve calculating stability limits. A stability limit can represent thresholds, and values beyond the thresholds may induce undesirable effects such as instability of, or excess wear on, the drill bit, wellbore structural-instability, motor stalling, etc. Stability limits can be determined based on two or more drilling parameters and can be plotted on a set of axes. An intersection of stability limits on the axes can be the wellbore-drilling envelope and can represent a set of satisficing parameters. Within the wellbore-drilling envelope, an ellipse can be formed that can represent an operationally stable region. The drilling parameters from the wellbore-drilling envelope can be compared to the real-time sensed data from the drilling operation, and a command in response to the comparison can be used to automatically control drilling equipment of the drilling operation for achieving one or more drilling objectives.

In some examples, a trained neural network can calculate stability limits for satisficing values of drilling parameters. To train the neural network, a computing system that includes a neural network can receive historical data about previously calculated wellbore-drilling envelopes, previously used equipment parameters, previously used drilling objectives, and previous results of drilling operations. The computing system can use the historical data in combination with at least one drilling objective to train the neural network to calculate stability limits of drilling parameters for outputting a wellbore-drilling envelope.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a cross-sectional view of a wellbore drilling system 100 that can be formed with drilling equipment using satisficing values of drilling parameters according to one example of the present disclosure. A wellbore used to extract hydrocarbons may be created by drilling into a subterranean formation 102 using the drilling system 100. The drilling system 100 may drive a bottom hole assembly (BHA) 104 positioned or otherwise arranged at the bottom of a drill-string 106 extended into the subterranean formation 102 from a derrick 108 arranged at the surface 110. The derrick 108 includes a kelly 112 used to lower and raise the drill-string 106. The BHA 104 may include a drill bit 114 operatively coupled to a tool string 116, which may be moved axially within a drilled wellbore 118 as attached to the drill-string 106. Tool string 116 may include one or more sensors 109, for determining conditions in the wellbore. Sensors 109 may be positioned on drilling equipment and sense values of drilling parameters for a drilling operation. The sensors 109 can send signals to the surface 110 via a wired or wireless connection, and the sensors 109 may send real-time data relating to the drilling operation to the surface 110. The combination of any support structure (in this example, derrick 108), any motors, electrical equipment, and support for the drill-string and tool string may be referred to herein as a drilling arrangement.

During operation, the drill bit 114 penetrates the subterranean formation 102 to create the wellbore 118. The BHA 104 can provide control of the drill bit 114 as the drill bit 114 advances into the subterranean formation 102. The combination of the BHA 104 and drill bit 114 can be referred to as a drilling tool. Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into the drill-string 106 and conveys the same to the drill bit 114. The mud exits one or more nozzles (not shown) arranged in the drill bit 114 and in the process cools the drill bit 114. After exiting the drill bit 114, the mud circulates back to the surface 110 via the annulus defined between the wellbore 118 and the drill-string 106, and hole cleaning can occur which involves returning the drill cuttings and debris to the surface. The cuttings and mud mixture are passed through a flow line 128 and are processed such that a cleaned mud is returned down hole through the stand pipe 126 once again.

The drilling arrangement and any sensors (through the drilling arrangement or directly) are connected to a computing device 140. In FIG. 1, the computing device 140 is illustrated as being deployed in a work vehicle 142; however, a computing device to receive data from sensors and to control drill bit 114 can be permanently installed with the drilling arrangement, be hand-held, or be remotely located. Although one computing device 140 is depicted in FIG. 1, in other examples, more than one computing device can be used, and together, the multiple computing devices can perform operations, such as those described in the present disclosure.

The computing device 140 can be positioned below-ground, aboveground, onsite, in a vehicle, offsite, etc. The computing device 140 can include a processor interfaced with other hardware via a bus. A memory, which can include any suitable tangible (and non-transitory) computer-readable medium, such as random-access memory ("RAM"), read-only memory ("ROM"), electrically erasable and programmable read-only memory ("EEPROM"), or the like, can embody program components that configure operation of the computing device 140. In some aspects, the computing device 140 can include input/output interface components (e.g., a display, printer, keyboard, touch-sensitive surface, and mouse) and additional storage.

The computing device 140 can include a communication device 144. The communication device 144 can represent one or more of any components that facilitate a network connection. In the example shown in FIG. 1, the communication devices 144 are wireless and can include wireless interfaces such as IEEE 802.11, Bluetooth, or radio interfaces for accessing cellular telephone networks (e.g., transceiver/antenna for accessing a CDMA, GSM, UMTS, or other mobile communications network). In some examples, the communication devices 144 can use acoustic waves, surface waves, vibrations, optical waves, or induction (e.g., magnetic induction) for engaging in wireless communications. In other examples, the communication device 144 can be wired and can include interfaces such as Ethernet, USB, IEEE 1394, or a fiber optic interface. In an example with at least one other computing device, the computing device 140 can receive wired or wireless communications from the other computing device and perform one or more tasks based on the communications.

The wellbore-drilling system 100 can be automatically controlled by the computing device 140 using a wellbore-drilling envelope generated using equipment parameters of equipment used in the drilling operation. The wellbore-drilling envelope can define a satisficing zone as being values for drilling parameters within constraints, and the drilling parameters can be used to control the drilling operation to achieve drilling objectives satisfactorily. The drilling parameters included in the wellbore-drilling envelope can be automatically input into drilling equipment by the computing device 140 for controlling the drilling operation. In other examples, an operator of the wellbore-drilling system 100 can manually input drilling parameters into drilling equipment for controlling the drilling operation.

Figure 2:
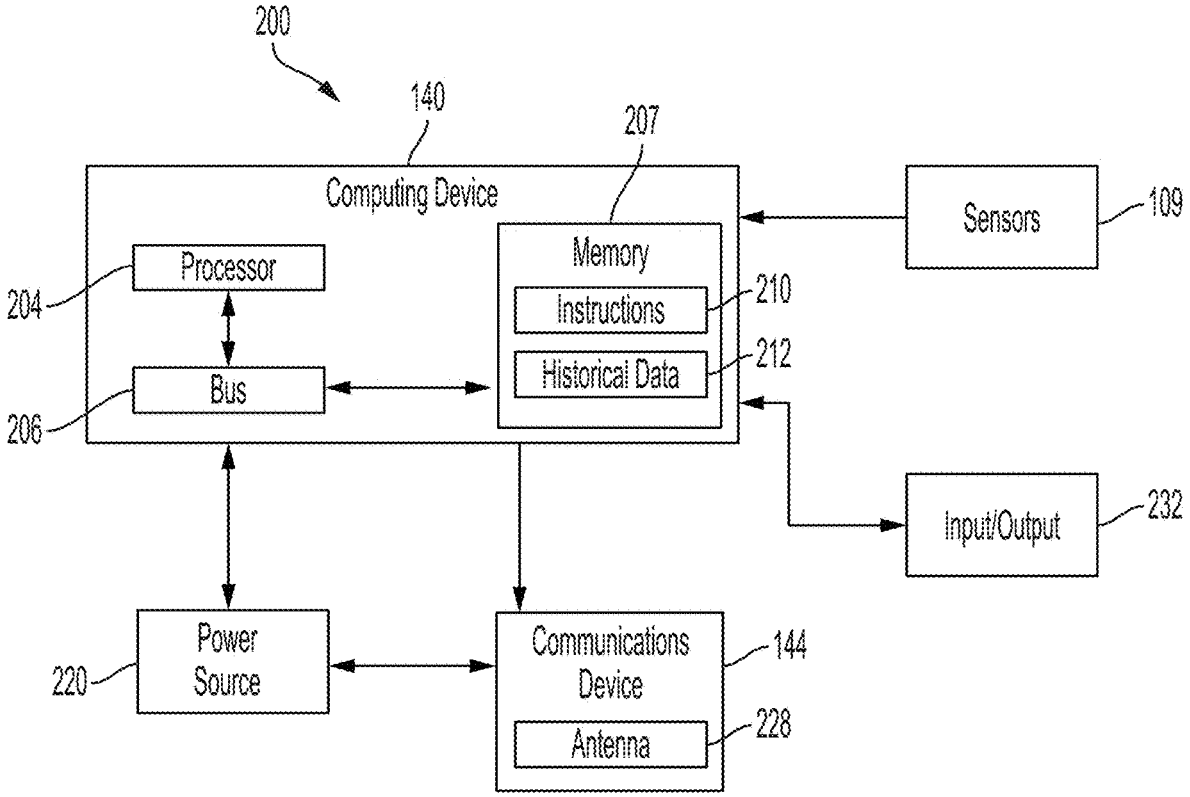
FIG. 2 is a block diagram of a computing system for automatically controlling drilling equipment with satisficing drilling parameters in a drilling operation according to one example of the present disclosure.

FIG. 2 is a block diagram of a computing system 200 for automatically controlling a drilling operation according to one example of the present disclosure. In some examples, the components shown in FIG. 2 (e.g., the computing device 140, power source 220, and communications device 144) can be integrated into a single structure. For example, the components can be within a single housing. In other examples, the components shown in FIG. 2 can be distributed via separate housings or otherwise, and in electrical communication with each other.

The system 200 includes the computing device 140. The computing device 140 can include a processor 204, a memory 207, and a bus 206. The processor 204 can execute one or more operations for automatically controlling the drilling operation. The processor 204 can execute instructions stored in the memory 207 to perform the operations. The processor 204 can include one processing device or multiple processing devices or cores. Non-limiting examples of the processor 204 include a Field-Programmable Gate Array ("FPGA"), an application-specific integrated circuit ("ASIC"), a microprocessor, etc.

The processor 204 can be communicatively coupled to the memory 207 via the bus 206. The non-volatile memory 207 may include any type of memory device that retains stored information when powered off. Non-limiting examples of the memory 207 include EEPROM, flash memory, or any other type of non-volatile memory. In some examples, at least part of the memory 207 can include a medium from which the processor 204 can read instructions. A computer-readable medium can include electronic, optical, magnetic, or other storage devices capable of providing the processor 204 with computer-readable instructions or other program code. Non-limiting examples of a computer-readable medium include (but are not limited to) magnetic disk(s), memory chip(s), ROM, RAM, an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

In some examples, the memory 207 can include computer program instructions 210 for automatically controlling a drilling operation in part by using input data from the sensor 109. The input data from the sensor 109 may be real-time data related to the wellbore 118 and related to values of drilling parameters. The instructions 210, when executed, may cause the processor 204 to calculate stability limits for drilling parameters and to output a wellbore-drilling envelope using the stability limits. The wellbore-drilling envelope formed by the processor 204 can include satisficing values of drilling parameters which, when input into a drilling operation, may achieve drilling objectives of the drilling operation. The wellbore-drilling envelope can be stored as historical data 212 for later use.

The system 200 can include a power source 220. The power source 220 can be in electrical communication with the computing device 140 and the communications device 144. In some examples, the power source 220 can include a battery or an electrical cable (e.g., a wireline). The power source 220 can include an AC signal generator. The computing device 140 can operate the power source 220 to apply a transmission signal to the antenna 228 to forward data relating to drilling parameters, drilling objectives, drilling operation results, etc. to other systems. For example, the computing device 140 can cause the power source 220 to apply a voltage with a frequency within a specific frequency range to the antenna 228. This can cause the antenna 228 to generate a wireless transmission. In other examples, the computing device 140, rather than the power source 220, can apply the transmission signal to the antenna 228 for generating the wireless transmission.

In some examples, part of the communications device 144 can be implemented in software. For example, the communications device 144 can include additional instructions stored in memory 207 for controlling functions of the communication device 144. The communications device 144 can receive signals from remote devices and transmit data to remote devices. For example, the communications device 144 can transmit wireless communications that are modulated by data via the antenna 228. In some examples, the communications device 144 can receive signals (e.g., associated with data to be transmitted) from the processor 204 and amplify, filter, modulate, frequency shift, and otherwise manipulate the signals. In some examples, the communications device 144 can transmit the manipulated signals to the antenna 228. The antenna 228 can receive the manipulated signals and responsively generate wireless communications that carry the data.

The computing system 200 can receive input from sensor (s) 109. The computing system 200 in this example also includes input/output interface 232. Input/output interface 232 can connect to a keyboard, pointing device, display, and other computer input/output devices. An operator may provide input using the input/output interface 232. Satisficing values of drilling parameters or other data related to the operation of the system can also be displayed to an operator through a display that is connected to or is part of input/output interface 232. The displayed values can provide an advisory function to a drill operator who can make adjustments based on the displayed values. Alternatively, the instructions 210 can exercise real-time control over the drilling operation through input/output interface 232, automatically altering drilling parameters based on updated wellbore-drilling envelopes, changing conditions in the subterranean formation 102 or wellbore 118, or the like.

Figure 3:
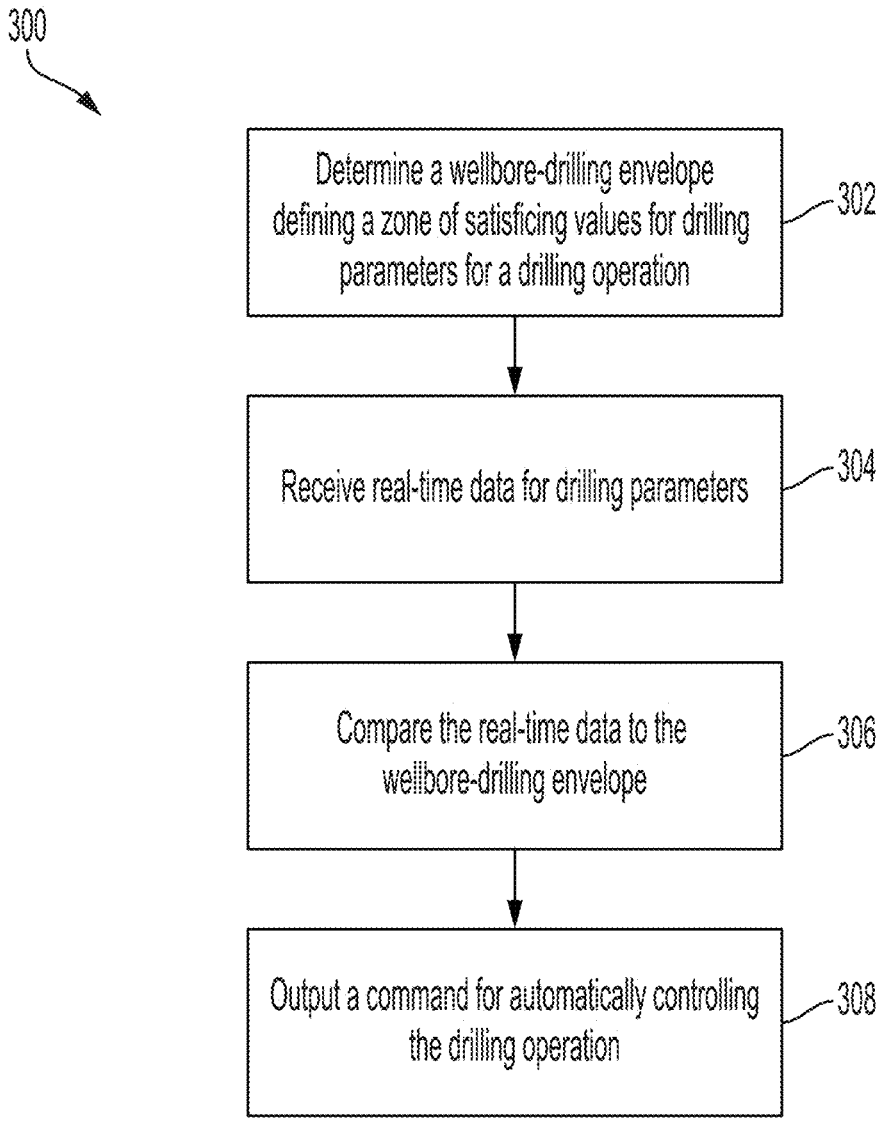
FIG. 3 is a flowchart of a process to output a command to automatically control drilling equipment in a drilling operation according to one example of the present disclosure.

FIG. 3 is a flowchart of a process 300 to output a command to automatically control drilling equipment in a drilling operation according to one example of the present disclosure. At block 302, a wellbore-drilling envelope is calculated by a computing system, for example the computing system 200 of FIG. 2. The wellbore-drilling envelope can define a zone of satisficing values for drilling parameters of a drilling operation. The drilling operation can be controlled automatically by the computing system that can calculate stability limits of various drilling parameters. Stability limits can represent threshold values for drilling parameters, and values of drilling parameters beyond the threshold values may induce undesirable effects. Stability limits of drilling parameters can be calculated as functions of multiple other drilling parameters. For example, stability limits of hole cleaning, ROP, and mechanical-specific energy can be calculated as functions of drill speed and WOB. An intersection of stability limits can be formed by combining the stability limits, and the intersection can be the wellbore-drilling envelope that can define a zone for satisficing values of drilling parameters. Drilling objectives can be achieved when using values of drilling parameters included in the wellbore-drilling envelope.

Other stability limits of drilling parameters can be calculated based on equipment being used. For example, if a specific type of motor is being used in the drilling operation, stability limits for motor-stall speed and motor-stall weight for the specific type of motor can be calculated. Various stability limits can be calculated that can depend on drilling equipment used in the drilling operation. For example, stability limits can be calculated for torsional instability and lateral instability, both of which may depend on a specific drill string used in the drilling operation. In a case in which drilling equipment is being used to change a trajectory of the wellbore, a stability limit of the energy can be calculated to change the trajectory of the wellbore. An equation of the energy can be:

$$E_s = \int_0^{\ell} (\kappa(x)^2 + \tau(x)^2)dx$$

where $E_s$ is the energy required to change the trajectory of the wellbore, k is a curvature of the wellbore, t is a torsion of the wellbore, and x is a distance.

At block 304, the computing system receives real-time data for drilling parameters. Sensors, such as the sensor 109 of FIG. 1, can be positioned downhole on drilling equipment and can transmit real-time data to the computing system relating to the subterranean formation 102 or the wellbore 118. The real-time data can include actual values of drilling parameters realized by the drilling operation and can be stored in the computing system for later use.

At block 306, the computing system compares the real-time data to the wellbore-drilling envelope. In this comparison, the computing system can determine whether the real-time data is a subset of the wellbore-drilling envelope. The computing system may determine that the real-time data is a subset of the wellbore-drilling envelope if the values, or most of the values, of drilling parameters contained in the real-time data are included in the wellbore-drilling envelope. In some examples, the computing system may determine that the real-time data is not a subset of the wellbore-drilling envelope if at least one value of drilling parameters contained in the real-time data is not included in the wellbore-drilling envelope.

At block 308, the computing system outputs a command for automatically controlling the drilling operation. Controlling the drilling operation can involve, for example, the computing system automatically feeding set points of drilling parameters included in the wellbore-drilling envelope into drilling equipment in response to comparing the real-time data and the wellbore-drilling envelope. In addition or alternatively, in response to comparing the real-time sensed data to the wellbore-drilling envelope, the computing system may generate and output a command for controlling the drilling operation to achieve drilling objectives that an operator may use to feed set points into drilling equipment. The command can include instructions to update drilling parameters of drilling equipment of the drilling operation or to not update drilling parameters. In an example in which the real-time data includes drilling parameters not within the wellbore-drilling envelope, the computing system may output a command to update drilling parameters of drilling equipment of the drilling operation to parameters within the wellbore-drilling envelope. In another example in which the real-time data includes drilling parameters within the wellbore-drilling envelope formed, the computing system may output a command to not update the drilling parameters. The computing system may omit a command in the case where drilling parameters are not desired to be updated.

Additionally or alternatively, the computing system may output a warning to an operator of the drilling operation. The operator may receive the warning on an input/output display, for example the input/output interface 232 of FIG. 2. In response to viewing the warning, the operator may choose to update drilling parameters of the drilling operation with values of drilling parameters included in the wellbore-drilling envelope calculated by the computing system.

Figure 4:
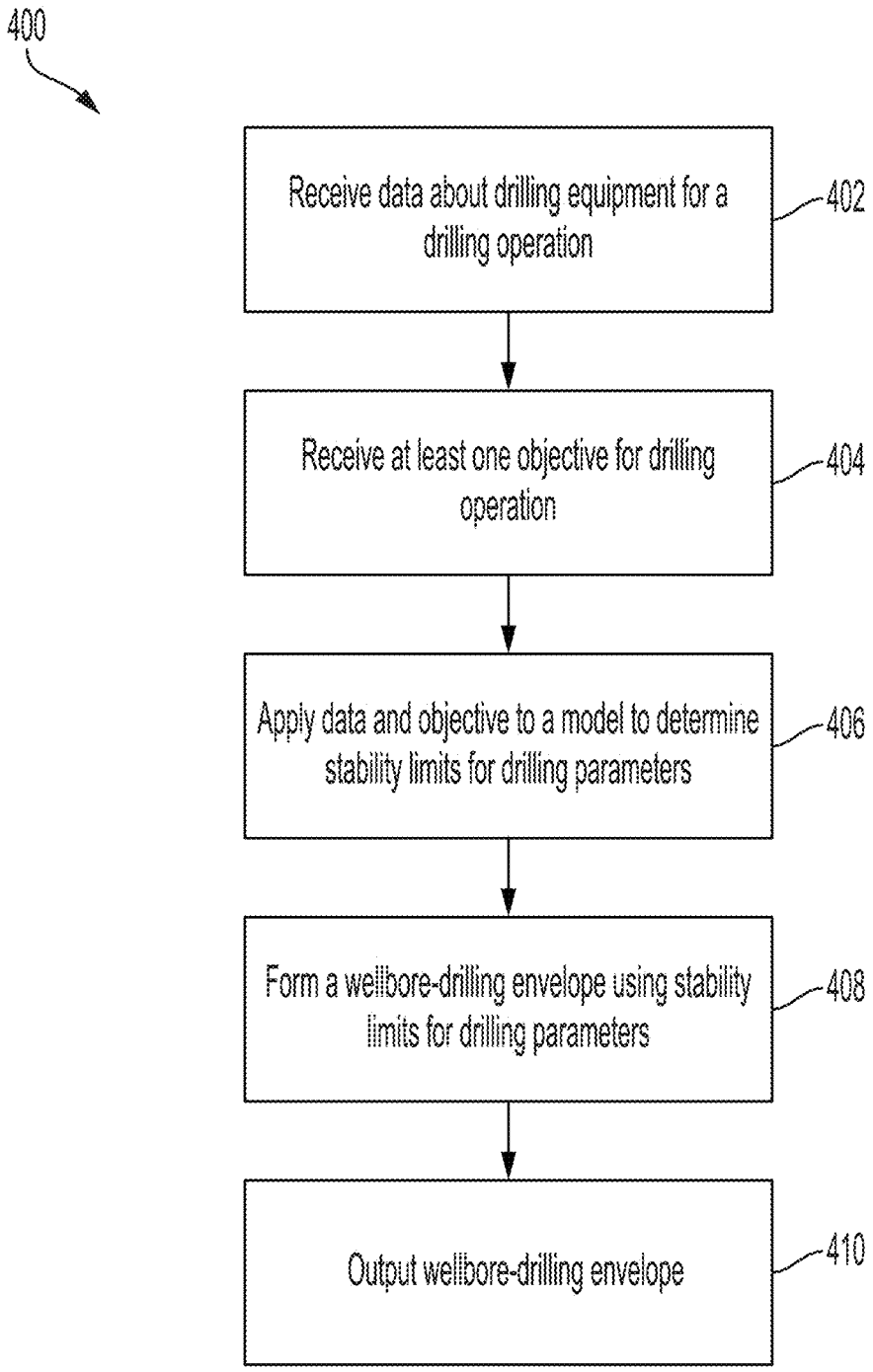
FIG. 4 is a flowchart of a process to generate a wellbore-drilling envelope according to one example of the present disclosure.

FIG. 4 is a flowchart of a process 400 for generating a wellbore-drilling envelope according to one example of the present disclosure. At block 402, a computing system, for example the computing system 200 of FIG. 2, of a drilling operation receives data about drilling equipment of the drilling operation. The data can include values of drilling parameters, such as WOB, drill speed, ROP, etc., used by drilling equipment, and the data can include real-time sensed data from the subterranean formation 102 or the wellbore 118.

At block 404, the computing system receives at least one objective for the drilling operation. The objective can represent a goal that an operator, or the computing system, of the drilling operation desires to achieve. Examples of a drilling objective can be to form a high-quality wellbore, to quickly form a wellbore that can produce a threshold value of hydrocarbon material, etc. The drilling objective can be stored by the computing system for later use.

At block 406, the computing system applies the data and the drilling objective to a model for determining stability limits of drilling parameters. The model can be an adaptive, engineering model and can take the data and the drilling objective as inputs. An output of the model can be a set of stability limits for drilling parameters.

An example of the model can be an uncertainty model that can calculate uncertainties of drilling parameters. The uncertainties can be different for different drilling parameters and can be used to calculate stability limits that can be used to form a wellbore-drilling envelope. In another example, various models of the wellbore can be used to calculate stability limits. The models of the wellbore can include a torque model, a drag model, a vibrational model, etc. The models of the wellbore can be used to calculate stability limits of drilling parameters that can be used to form the wellbore-drilling envelope.

At block 408, the computing system calculates a wellbore-drilling envelope using the stability limits. Stability limits of drilling parameters can be combined by the computing system, and this combination can result in an intersection of stability limits of drilling parameters. Values within the intersection of stability limits of drilling parameters can be considered satisficing: reasonable, or acceptable drilling parameters for achieving the drilling objective. The wellbore-drilling envelope can include the satisficing values of drilling parameters within the intersection of stability limits of drilling parameters.

At block 410, the computing system outputs the wellbore-drilling envelope. The computing system can store the wellbore-drilling envelope for later use. The computing system may use the wellbore-drilling envelope as an input for outputting a command for automatically controlling the drilling operation. In other examples, the wellbore-drilling envelope may be output to a display, for example the input/output interface 232 of FIG. 2, to be viewed by an operator of the drilling operation. The drilling operator may choose to update drilling parameters of the drilling operation based on the wellbore-drilling envelope calculated by the computing system.

Additionally or alternatively, a wellbore-drilling envelope can be calculated offline. For example, it may be desirable to calculate the wellbore-drilling envelope for pre-planning a new wellbore. The pre-planning wellbore-drilling envelope can be used to project satisficing solutions for starting the new wellbore, and values of drilling parameters contained within the pre-planning wellbore-drilling envelope may be used without comparing to real-time data from the new wellbore.

Figure 5:
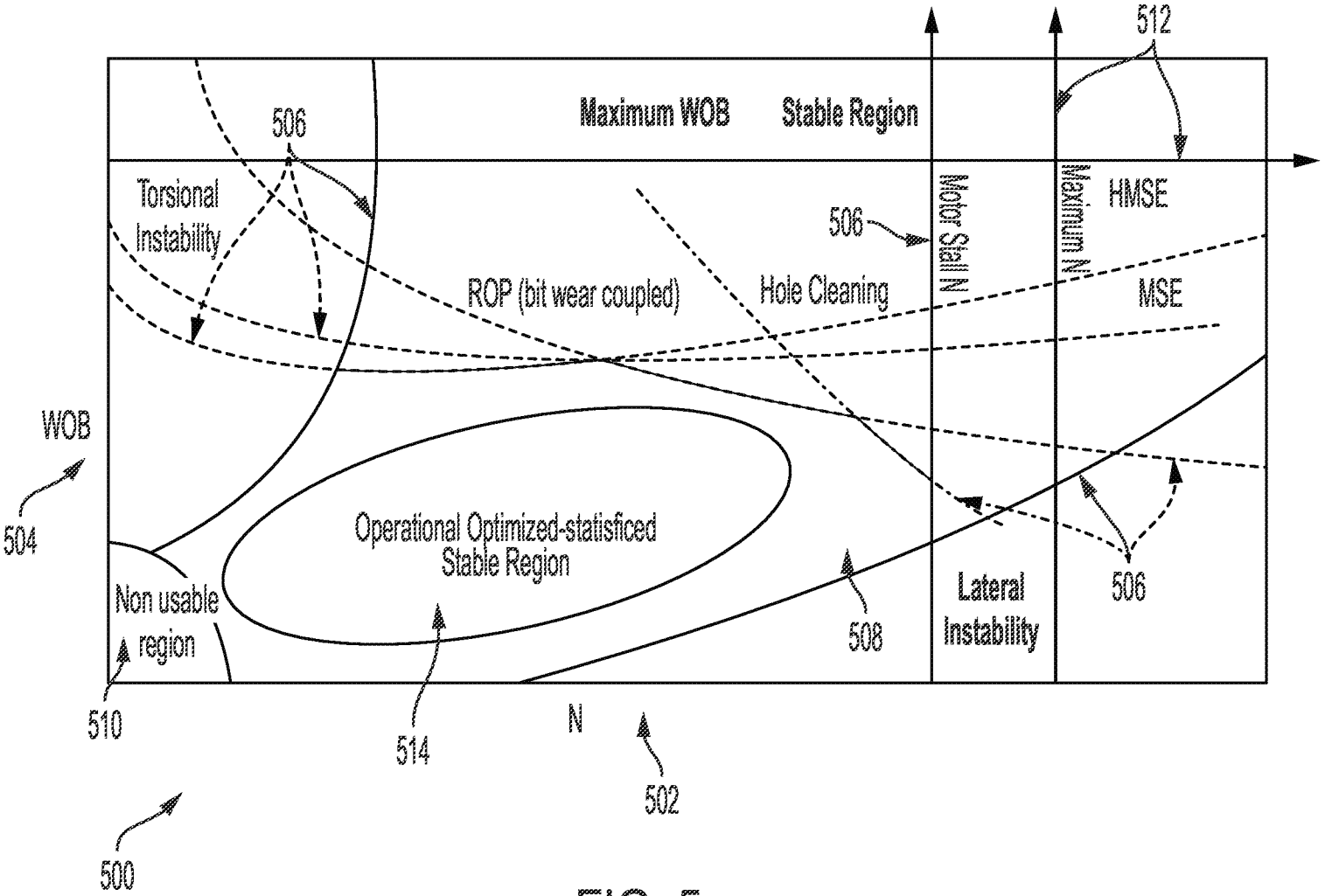
FIG. 5 is a plot of a drilling parameter envelope with a satisficing ellipse according to one example of the present disclosure.

FIG. 5 is a plot 500 of a wellbore-drilling envelope with a satisficing region according to one example of the present disclosure. The plot 500 as shown has a horizontal axis 502, which represents drill speed ("N"), and a vertical axis 504, which represents WOB. Stability limits 506, calculated as functions of drill speed and WOB, are shown on the plot 500 for drilling parameters: torsional instability, ROP, hole cleaning, motor-stall speed, mechanical-specific energy, hydro-mechanical-specific energy, and lateral instability. The plot 500 shows a combination of seven stability limits of drilling parameters forming the wellbore-drilling envelope, but any suitable number of stability limits of drilling parameters can be calculated and combined to form the wellbore-drilling envelope. For example, a smaller number of stability limits of drilling parameters can be calculated. Stability limits for torsional instability, lateral instability, ROP, and hole cleaning can be calculated and combined to form the wellbore-drilling envelope.

When plotted on the axes 502, 504, the stability limits 506 can form an intersection that is a wellbore-drilling envelope 508. Values of drilling parameters within the wellbore-drilling envelope 508 can be satisficing can be used for a drilling operation to achieve one or more drilling objectives. Values of drilling parameters within the wellbore-drilling envelope 508 can also be optimizing. A non-usable region 510 is depicted in FIG. 5 and can include values that are satisficing but are impractical (e.g. 0 drill speed or 0 WOB). Maximums 512 for N and for WOB are also depicted in FIG. 5, and the maximums 512 can represent values over which drilling equipment cannot function.

The wellbore-drilling envelope 508 can include a stable region 514 of operational optimized-satisficed values of drilling parameters. The stable region 514 is an ellipse, but other shapes can be used that are suitable for defining a zone for operational optimized-satisficed values of drilling parameters. The stable region can include values of drilling parameters that can be considered optimizing, satisficing, or a combination thereof. But, the stable region may omit values of drilling parameters that are near boundary values, or stability limits 506, of the wellbore-drilling envelope since these boundary value drilling parameters may not be desired or may not be considered useful. Drilling parameters that may not be desirable or considered useful can include drilling parameter values in which drill speed or WOB are near zero or that are near stability limits. Stability limits can include uncertainty in the values of the stability limits, and values of drilling parameters that are within the wellbore-drilling envelope that are near stability limits may not be desirable since uncertainty in the stability limit may cause the actual values of drilling parameters to not be within the wellbore-drilling envelope.

Figure 6:
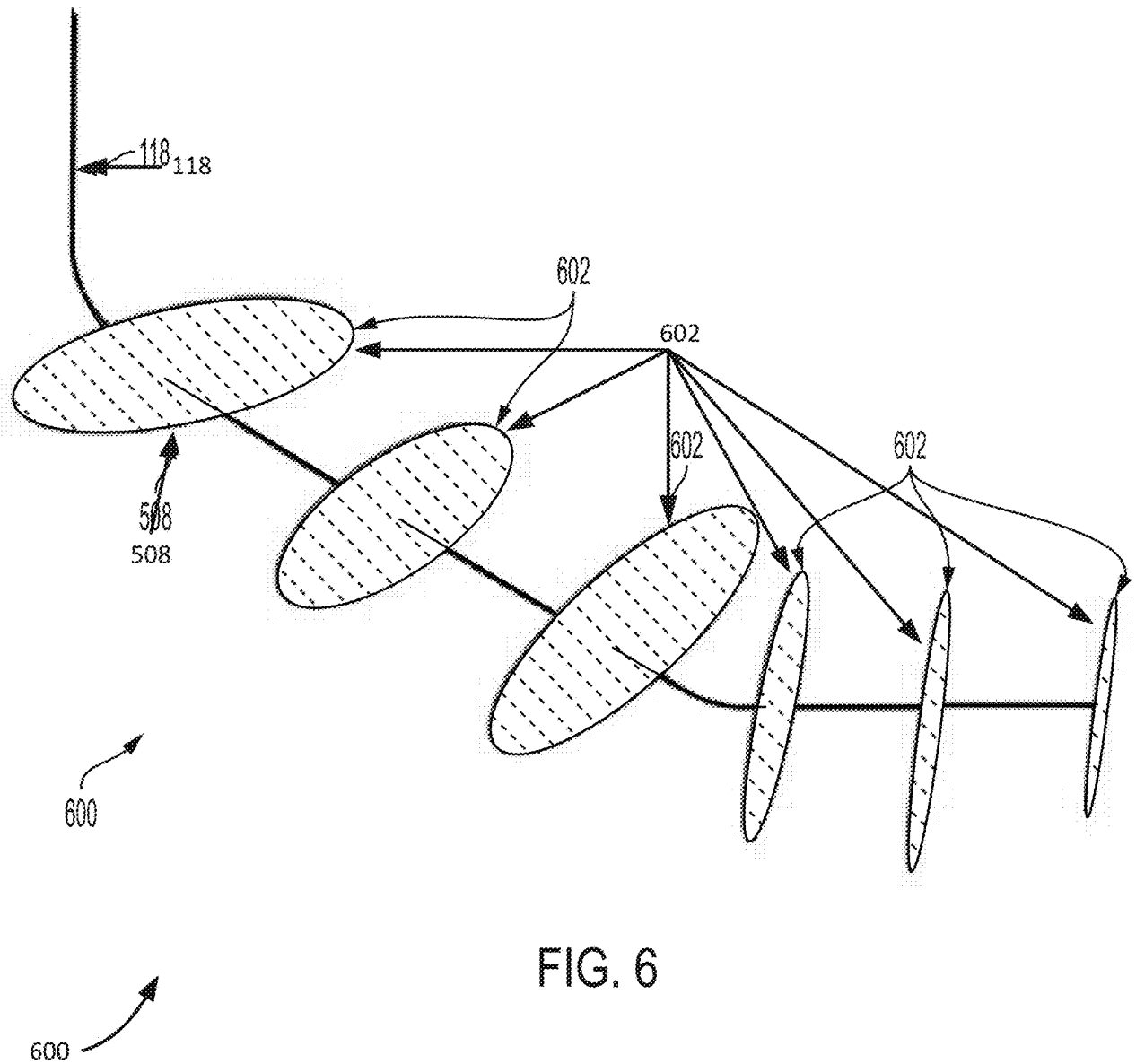
FIG. 6 is a flow diagram of drilling parameter envelopes associated with different time intervals for a drilling operation according to one example of the present disclosure.

FIG. 6 is a flow diagram 600 of wellbore-drilling envelopes associated with distinct, discrete intervals 602 for a drilling operation according to one example of the present disclosure. The discrete intervals 602 can represent a small measure of time or a small measure of drilling depth. As depicted in FIG. 6, there are six discrete intervals 602, but there can be as many discrete intervals 602 as are useful to achieve drilling objectives of the drilling operation. A new wellbore-drilling envelope 508 can be calculated for each discrete interval 602.

The wellbore 118 can be depicted on the flow diagram 600, and the flow diagram 600 can represent a shape of the wellbore 118. As depicted in the flow diagram 600, each interval 602 includes a stable region 514, contained within the wellbore-drilling envelope 508, of operational optimized-satisficed values of drilling parameters. FIG. 6 shows the stable regions 514 of the discrete intervals 602 as ellipses, but the stable regions 514 can be any shape suitable for representing operational optimized-satisficed values of drilling parameters. Each stable region 514 may include unique values of drilling parameters.

A computing system, for example the computing system 200 of FIG. 2, can calculate stable regions 514 of the wellbore-drilling envelopes 508 at different intervals 602. In response to calculating each stable region 514, the computing system may output a command to control the drilling operation. The command may include instructions to update values of drilling parameters used by drilling equipment or to not update values of drilling parameters used by drilling equipment. The computing system can compare a newly calculated stable region 514 of a next interval 602 to a stable region 514 of a current interval 602. The computing system may determine that the newly calculated stable region 514 does not contain drilling parameters currently in use by drilling equipment of the drilling operation in the current interval 602. In this case, the computing system may output a command to update values of drilling parameters to those that are included in the newly calculated stable region 514. The command may be automatically outputted to drilling equipment by the computing system, or the command may be displayed to an operator of the drilling system via a display, for example the input/output interface 232 of FIG. 2. The operator may choose to manually input the command into drilling equipment.

In comparing values to the wellbore-drilling envelope, the computing system may determine that the newly calculate stable region 514 contains drilling parameters currently in use by drilling equipment of the drilling operation in the current interval 602. In this case, the computing system may output a command that does not update values of drilling parameters used by drilling equipment. The command may be automatically input into drilling equipment by the computing system, or the command may be displayed to an operator of the drilling system via a display, for example the input/output interface 232 of FIG. 2. The operator may choose to manually input the command into drilling equipment. In other examples, the computing system may omit a command if the computing system determines that the newly calculated stable region 514 contains values of drilling parameters currently in use.

In some aspects, systems, methods, and non-transitory computer-readable mediums for automatically controlling a wellbore drilling operation are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a processor; and a non-transitory computer-readable medium comprising instructions that are executable by the processor to cause the processor to perform operations comprising: determining a wellbore-drilling envelope defining a zone for satisficed values of a plurality of drilling parameters for a drilling operation; receiving real-time data for the plurality of drilling parameters; comparing the real-time data to the wellbore-drilling envelope; and outputting, in response to comparing the real-time data to the wellbore-drilling envelope, a command for automatically controlling the drilling operation.

Example 2 is the system of example 1, wherein the plurality of drilling parameters comprises weight on bit, rate of penetration, revolutions per minute, torsional instability, lateral instability, and hole cleaning.

Example 3 is the system of examples 1 and 2, wherein the plurality of drilling parameters further comprises mechanical-specific energy, hydro-mechanical-specific energy, motor-stall weight, and motor-stall speed.

Example 4 is the system of example 1, wherein the operations further comprise: determining a subsequent wellbore-drilling envelope for a subsequent drilling interval of the drilling operation; receiving subsequent real-time data for the plurality of drilling parameters and associated with the subsequent drilling interval; comparing the subsequent real-time data to the subsequent wellbore-drilling envelope; and outputting, in response to comparing the subsequent real-time data to the subsequent wellbore-drilling envelope, a subsequent command for automatically controlling the drilling operation.

Example 5 is the system of example 1, wherein the wellbore-drilling envelope is configured to be calculated offline, and wherein the operation of determining the wellbore-drilling envelope comprises: receiving data about drilling equipment to be used for the drilling operation; receiving at least one objective for the drilling operation; applying the data and the at least one objective to a model to determine a plurality of stability limits for the plurality of drilling parameters; forming the wellbore-drilling envelope using the plurality of stability limits for the plurality of drilling parameters; and outputting the wellbore-drilling envelope.

Example 6 is the system of examples 1 and 5, wherein the non-transitory computer-readable medium further comprises instructions that are executable by the processor to cause the processor to: receive stored historical data about previous wellbore-drilling envelopes, previous equipment parameters, previous drilling objectives, and drilling operation results associated with the previous wellbore-drilling envelopes, the previous equipment parameters, and the previous drilling objectives; and use the stored historical data to train the model to generate a trained model, the trained model being a neural network, wherein the operation of forming the wellbore-drilling envelope includes applying the data and the at least one objective to the trained model to generate the plurality of stability limits for the plurality of drilling parameters.

Example 7 is the system of examples 1 and 5, wherein the wellbore-drilling envelope comprises the plurality of stability limits for the plurality of drilling parameters, and wherein the plurality of drilling parameters comprises satisficed and optimized solutions of the model.

Example 8 is a method comprising: determining, by a computing device, a wellbore-drilling envelope defining a zone for satisficed values of a plurality of drilling parameters for a drilling operation; receiving, by the computing device, real-time data for the plurality of drilling parameters; comparing, by the computing device, the real-time data to the wellbore-drilling envelope; and outputting, by the computing device in response to comparing the real-time data to the wellbore-drilling envelope, a command for automatically controlling the drilling operation.

Example 9 is the method of examples 8, wherein the plurality of drilling parameters comprises weight on bit, rate of penetration, revolutions per minute, torsional instability, lateral instability, and hole cleaning.

Example 10 is the method of examples 8 and 9, wherein the plurality of drilling parameters further comprises mechanical-specific energy, hydro-mechanical-specific energy, motor-stall weight, and motor-stall speed.

Example 11 is the method of example 8, further comprising: determining a subsequent wellbore-drilling envelope for a subsequent drilling interval of the drilling operation; receiving subsequent real-time data for the plurality of drilling parameters and associated with the subsequent drilling interval; comparing the subsequent real-time data to the subsequent wellbore-drilling envelope; and outputting, in response to comparing the subsequent real-time data to the subsequent wellbore-drilling envelope, a subsequent command for automatically controlling the drilling operation.

Example 12 is the method of example 8, wherein determining, by the computing device, the wellbore-drilling envelope comprises: receiving data about drilling equipment to be used for the drilling operation; receiving at least one objective for the drilling operation; applying the data and the at least one objective to a model to determine a plurality of stability limits for the plurality of drilling parameters; forming the wellbore-drilling envelope using the plurality of stability limits for the plurality of drilling parameters; and outputting the wellbore-drilling envelope.

Example 13 is the method of examples 8 and 12, further comprising: receiving stored historical data about previous wellbore-drilling envelopes, previous equipment parameters, previous drilling objectives, and drilling operation results associated with the previous wellbore-drilling envelopes, the previous equipment parameters, and the previous drilling objectives; and using the stored historical data to train the model to generate a trained model, the trained model being a neural network, wherein forming the wellbore-drilling envelope includes applying the data and the at least one objective to the trained model to generate the plurality of stability limits for the plurality of drilling parameters.

Example 14 is the method of examples 8 and 12, wherein the wellbore-drilling envelope comprises a combination of the plurality of stability limits for the plurality of drilling parameters, and wherein the plurality of drilling parameters comprises both satisficed and optimized solutions of the model.

Example 15 is a non-transitory computer-readable medium comprising instructions that are executable by a processing device for causing the processing device to perform operations comprising: determining a wellbore-drilling envelope defining a zone for satisficed values of a plurality of drilling parameters for a drilling operation; receiving real-time data for the plurality of drilling parameters; comparing the real-time data to the wellbore-drilling envelope; and outputting, in response to comparing the real-time data to the wellbore-drilling envelope, a command for automatically controlling the drilling operation.

Example 16 is the non-transitory computer-readable medium of example 15, wherein the plurality of drilling parameters comprises weight on bit, rate of penetration, revolutions per minute, torsional instability, lateral instability, hole cleaning, mechanical-specific energy, hydro-mechanical-specific energy, motor-stall weight, and motor-stall speed.

Example 17 is the non-transitory computer-readable medium of example 15, further comprising instructions that are executable by the processing device for causing the processing device to perform operations comprising: determining a subsequent wellbore-drilling envelope for a subsequent drilling interval of the drilling operation; receiving subsequent real-time data for the plurality of drilling parameters and associated with the subsequent drilling interval; comparing the subsequent real-time data to the subsequent wellbore-drilling envelope; and outputting, in response to comparing the subsequent real-time data to the subsequent wellbore-drilling envelope, a subsequent command for automatically controlling the drilling operation.

Example 18 is the non-transitory computer-readable medium of example 15, wherein the operation of determining the wellbore-drilling envelope comprises: receiving data about drilling equipment to be used for the drilling operation; receiving at least one objective for the drilling operation; applying the data and the at least one objective to a model to determine a plurality of stability limits for the plurality of drilling parameters; forming the wellbore-drilling envelope using the plurality of stability limits for the plurality of drilling parameters; and outputting the wellbore-drilling envelope.

Example 19 is the non-transitory computer-readable medium of examples 15 and 18, further comprising instructions that are executable by the processing device for causing the processing device to perform operations comprising: receive stored historical data about previous wellbore-drilling envelopes, previous equipment parameters, previous drilling objectives, and drilling operation results associated with the previous wellbore-drilling envelopes, the previous equipment parameters, and the previous drilling objectives; and use the stored historical data to train the model to generate a trained model, the trained model being a neural network, wherein the operation of forming the wellbore-drilling envelope includes applying the data and the at least one objective to the trained model to generate the plurality of stability limits for the plurality of drilling parameters.

Example 20 is the non-transitory computer-readable medium of examples 15 and 18, wherein the wellbore-drilling envelope comprises a combination of the plurality of stability limits for the plurality of drilling parameters, and wherein the plurality of drilling parameters comprises both satisficed and optimized solutions of the model.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a processor; and a non-transitory computer-readable medium comprising instructions that are executable by the processor to cause the processor to perform operations comprising:

determining a wellbore-drilling envelope defining a zone for satisficed values of a plurality of drilling parameters for a drilling operation, the wellbore-drilling envelope including a plurality of limits corresponding to the plurality of drilling parameters, the zone for satisficed values of the plurality of drilling parameters being an intersection of the plurality of limits;

receiving real-time data for the plurality of drilling parameters;

comparing the real-time data to the wellbore-drilling envelope; and outputting, in response to comparing the real-time data to the wellbore-drilling envelope, a command for automatically controlling the drilling operation.

2. The system of claim 1, wherein the plurality of drilling parameters comprises weight on bit, rate of penetration, revolutions per minute, torsional instability, lateral instability, and hole cleaning.

3. The system of claim 2, wherein the plurality of drilling parameters further comprises mechanical-specific energy, hydro-mechanical-specific energy, motor-stall weight, and motor-stall speed.

4. The system of claim 1, wherein the operations further comprise:

determining a subsequent wellbore-drilling envelope for a subsequent drilling interval of the drilling operation;

receiving subsequent real-time data for the plurality of drilling parameters and associated with the subsequent drilling interval;

comparing the subsequent real-time data to the subsequent wellbore-drilling envelope; and outputting, in response to comparing the subsequent real-time data to the subsequent wellbore-drilling envelope, a subsequent command for automatically controlling the drilling operation.

5. The system of claim 1, wherein the plurality of limits is a plurality of stability limits of the plurality of drilling parameters, wherein the wellbore-drilling envelope is configured to be calculated offline, and wherein the operation of determining the wellbore-drilling envelope comprises:

receiving data about drilling equipment to be used for the drilling operation;

receiving at least one objective for the drilling operation;

applying the data and the at least one objective to a model to determine the plurality of stability limits for the plurality of drilling parameters;

forming the wellbore-drilling envelope using the plurality of stability limits for the plurality of drilling parameters; and outputting the wellbore-drilling envelope.

6. The system of claim 5, wherein the non-transitory computer-readable medium further comprises instructions that are executable by the processor to cause the processor to:

receive stored historical data about previous wellbore-drilling envelopes, previous equipment parameters, previous drilling objectives, and drilling operation results associated with the previous wellbore-drilling envelopes, the previous equipment parameters, and the previous drilling objectives; and use the stored historical data to train the model to generate a trained model, the trained model being a neural network, wherein the operation of forming the wellbore-drilling envelope includes applying the data and the at least one objective to the trained model to generate the plurality of stability limits for the plurality of drilling parameters.

7. The system of claim 5, wherein the wellbore-drilling envelope comprises the plurality of stability limits for the plurality of drilling parameters, and wherein the plurality of drilling parameters comprises satisficed and optimized solutions of the model.

8. A method comprising:

determining, by a computing device, a wellbore-drilling envelope defining a zone for satisficed values of a plurality of drilling parameters for a drilling operation, the wellbore-drilling envelope determined by:

determining a plurality of limits corresponding to the plurality of drilling parameters; and determining an intersection of the plurality of limits, the intersection being the zone for satisficed values of the plurality of drilling parameters;

receiving, by the computing device, real-time data for the plurality of drilling parameters;

comparing, by the computing device, the real-time data to the wellbore-drilling envelope; and outputting, by the computing device in response to comparing the real-time data to the wellbore-drilling envelope, a command for automatically controlling the drilling operation.

9. The method of claim 8, wherein the plurality of drilling parameters comprises weight on bit, rate of penetration, revolutions per minute, torsional instability, lateral instability, and hole cleaning.

10. The method of claim 8, wherein the plurality of drilling parameters further comprises mechanical-specific energy, hydro-mechanical-specific energy, motor-stall weight, and motor-stall speed.

11. The method of claim 8, further comprising:

determining a subsequent wellbore-drilling envelope for a subsequent drilling interval of the drilling operation;

receiving subsequent real-time data for the plurality of drilling parameters and associated with the subsequent drilling interval;

comparing the subsequent real-time data to the subsequent wellbore-drilling envelope; and outputting, in response to comparing the subsequent real-time data to the subsequent wellbore-drilling envelope, a subsequent command for automatically controlling the drilling operation.

12. The method of claim 8, wherein determining the plurality of limits includes determining a plurality of stability limits for the plurality of drilling parameters, and wherein determining, by the computing device, the wellbore-drilling envelope comprises:

receiving data about drilling equipment to be used for the drilling operation;

receiving at least one objective for the drilling operation;

applying the data and the at least one objective to a model to determine the plurality of stability limits for the plurality of drilling parameters;

forming the wellbore-drilling envelope using the plurality of stability limits for the plurality of drilling parameters; and outputting the wellbore-drilling envelope.

13. The method of claim 12, further comprising:

receiving stored historical data about previous wellbore-drilling envelopes, previous equipment parameters, previous drilling objectives, and drilling operation results associated with the previous wellbore-drilling envelopes, the previous equipment parameters, and the previous drilling objectives; and using the stored historical data to train the model to generate a trained model, the trained model being a neural network, wherein forming the wellbore-drilling envelope includes applying the data and the at least one objective to the trained model to generate the plurality of stability limits for the plurality of drilling parameters.

14. The method of claim 12, wherein the wellbore-drilling envelope comprises a combination of the plurality of stability limits for the plurality of drilling parameters, and wherein the plurality of drilling parameters comprises both satisficed and optimized solutions of the model.

15. A non-transitory computer-readable medium comprising instructions that are executable by a processing device for causing the processing device to perform operations comprising:

determining a wellbore-drilling envelope defining a zone for satisficed values of a plurality of drilling parameters for a drilling operation, the wellbore-drilling envelope determined by:

determining a plurality of limits corresponding to the plurality of drilling parameters for the drilling operation; and determining an intersection of the plurality of limits, the intersection being the zone for satisficed values of the plurality of drilling parameters;

receiving real-time data for the plurality of drilling parameters;

comparing the real-time data to the wellbore-drilling envelope; and outputting, in response to comparing the real-time data to the wellbore-drilling envelope, a command for automatically controlling the drilling operation.

16. The non-transitory computer-readable medium of claim 15, wherein the plurality of drilling parameters comprises weight on bit, rate of penetration, revolutions per minute, torsional instability, lateral instability, hole cleaning, mechanical-specific energy, hydro-mechanical-specific energy, motor-stall weight, and motor-stall speed.

17. The non-transitory computer-readable medium of claim 15, further comprising instructions that are executable by the processing device for causing the processing device to perform operations comprising:

determining a subsequent wellbore-drilling envelope for a subsequent drilling interval of the drilling operation;

receiving subsequent real-time data for the plurality of drilling parameters and associated with the subsequent drilling interval;

comparing the subsequent real-time data to the subsequent wellbore-drilling envelope; and outputting, in response to comparing the subsequent real-time data to the subsequent wellbore-drilling envelope, a subsequent command for automatically controlling the drilling operation.

18. The non-transitory computer-readable medium of claim 15, wherein the operation of determining the plurality of limits includes determining a plurality of stability limits for the plurality of drilling parameters, and wherein the operation of determining the wellbore-drilling envelope comprises:

receiving data about drilling equipment to be used for the drilling operation;

receiving at least one objective for the drilling operation;

applying the data and the at least one objective to a model to determine the plurality of stability limits for the plurality of drilling parameters;

forming the wellbore-drilling envelope using the plurality of stability limits for the plurality of drilling parameters; and outputting the wellbore-drilling envelope.

19. The non-transitory computer-readable medium of claim 18, further comprising instructions that are executable by the processing device for causing the processing device to perform operations comprising:

receive stored historical data about previous wellbore-drilling envelopes, previous equipment parameters, previous drilling objectives, and drilling operation results associated with the previous wellbore-drilling envelopes, the previous equipment parameters, and the previous drilling objectives; and use the stored historical data to train the model to generate a trained model, the trained model being a neural network, wherein the operation of forming the wellbore-drilling envelope includes applying the data and the at least one objective to the trained model to generate the plurality of stability limits for the plurality of drilling parameters.

20. The non-transitory computer-readable medium of claim 18, wherein the wellbore-drilling envelope comprises a combination of the plurality of stability-limits for the plurality of drilling parameters, and wherein the plurality of drilling parameters comprises both satisficed and optimized solutions of the model.

* * * * *